US012221968B1

(12) United States Patent
Yeh et al.

(10) Patent No.: US 12,221,968 B1
(45) Date of Patent: Feb. 11, 2025

(54) ROTOR ASSEMBLY AND FLUID TRANSMISSION DEVICE HAVING THE SAME

(71) Applicant: ACCTON TECHNOLOGY CORPORATION, Hsinchu (TW)

(72) Inventors: Jih-Che Yeh, Hsinchu (TW); Ting Jui Chang, Taipei (TW); Ting-Min Chen, Hsinchu (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 0 days.

(21) Appl. No.: 18/656,599

(22) Filed: May 7, 2024

Related U.S. Application Data

(60) Provisional application No. 63/596,299, filed on Nov. 5, 2023.

(51) Int. Cl.

| | |
|---|---|
| ***F04D 25/02*** | (2006.01) |
| ***F04D 19/00*** | (2006.01) |
| ***F04D 29/32*** | (2006.01) |

(52) U.S. Cl.
CPC ..... *F04D 25/022* (2013.01); *F04D 19/002* (2013.01); *F04D 29/329* (2013.01)

(58) Field of Classification Search
CPC ..... F04D 25/022; F04D 19/002; F04D 29/329
See application file for complete search history.

(56) References Cited

U.S. PATENT DOCUMENTS

| | | | | |
|---|---|---|---|---|
| 5,450,773 | A * | 9/1995 | Darrah | B25B 13/463 81/57.39 |
| 6,358,009 | B1 * | 3/2002 | Link | F04D 29/329 416/169 R |
| 6,474,936 | B1 * | 11/2002 | deBlanc | F04D 29/282 415/125 |
| 6,972,956 | B2 * | 12/2005 | Franz | H05K 7/20727 361/679.48 |
| 7,014,420 | B2 * | 3/2006 | Chang | F04D 19/007 415/121.2 |
| 7,054,156 | B2 * | 5/2006 | Espinoza-Ibarra | F04D 29/366 416/1 |
| 10,619,681 | B2 * | 4/2020 | Kimes | F16D 27/004 |
| 11,142,433 | B2 * | 10/2021 | Sikora | B66C 13/08 |

(Continued)

FOREIGN PATENT DOCUMENTS

CN 221704021 U * 9/2024

*Primary Examiner* — Brian Christopher Delrue
(74) *Attorney, Agent, or Firm* — CKC & Partners Co., LLC

(57) ABSTRACT

A rotor assembly includes a rotation axis, a propeller, an active ring, a driver link, and a reciprocating spring. The propeller includes a hub portion and fan blades. The hub portion is located on one end of the rotation axis, and the inner sidewall of the hub portion has a gear structure surrounding the rotation axis. The active ring sleeves on the rotation axis. The driver link is pivotally connected to the active ring. The reciprocating spring is telescopically disposed on the active ring and abuts against the driver link. When the rotation axis drives the active ring to rotate, the driver link abuts against the gear structure of the hub portion and compresses the reciprocating spring. When the rotation axis stops rotating, the reciprocating spring returns to an initial position to push the driver link to separate from the gear structure.

16 Claims, 7 Drawing Sheets

(56) References Cited

U.S. PATENT DOCUMENTS

| | | | | |
|---|---|---|---|---|
| 2002/0150463 | A1* | 10/2002 | deBlanc | F04D 29/282<br>415/33 |
| 2005/0047087 | A1* | 3/2005 | Espinoza-Ibarra | F04D 29/329<br>361/695 |
| 2005/0056405 | A1* | 3/2005 | Hashimoto | F04D 29/384<br>257/E23.099 |
| 2020/0362878 | A1* | 11/2020 | Li | F21V 33/0096 |
| 2021/0078837 | A1* | 3/2021 | Sikora | F04D 27/004 |
| 2023/0117222 | A1* | 4/2023 | Wang | F04D 29/005<br>362/96 |

* cited by examiner

ROTOR ASSEMBLY AND FLUID TRANSMISSION DEVICE HAVING THE SAME

CROSS-REFERENCE TO RELATED APPLICATIONS

This application claims priority to U.S. Provisional Application Ser. No. 63/596,299, filed Nov. 5, 2023, which is herein incorporated by reference.

BACKGROUND

Field of Invention

The present disclosure relates to a rotor assembly and a fluid transmission device having the rotor assembly.

Description of Related Art

Various electronic equipment, such as computers, data switches, servers, etc. that are common in daily life, will generate varying degrees of heat energy during operation, especially electronic components that require high-speed computing, such as central processing units (CPUs), graphics processing unit (GPU), etc., which will generate a large amount of heat energy during operation. The heat energy is accumulated in the electronic equipment so as to increase the temperature of the electronic equipment, which not only affects performance, but also reduces the stability and functionality of the electronic components.

In order to prevent high heat from affecting the operation of the electronic equipment, heat dissipation devices can be assembled to the electronic equipment to reduce the temperature of the electronic components inside the electronic equipment. In order to improve the heat dissipation effect, liquid heat dissipation devices have been widely used, and liquid used in a liquid heat dissipation device needs to be driven by a transmission device. Traditionally, a motor having an impeller can be used to drive the flow of fluid. However, when the motor stops running, the stopped impeller will cause resistance to the fluid. Although it can be overcome by using additional ratchet structures and springs, the above components occupy space and have complex structures, which is not conducive to miniaturization design and product competitiveness.

SUMMARY

According to some embodiments of the present disclosure, a rotor assembly includes a rotation axis, a propeller, an active ring, at least one driver link, and at least one reciprocating spring. The propeller includes a hub portion and plural fan blades extending outward from the hub portion. The hub portion is located on one end of the rotation axis, and an inner sidewall of the hub portion has a gear structure surrounding the rotation axis. The active ring sleeves on the rotation axis. The driver link is pivotally connected to the active ring. The reciprocating spring is telescopically disposed on the active ring and abuts against the driver link. When the rotation axis drives the active ring to rotate, the driver link abuts against the gear structure of the hub portion and compresses the reciprocating spring due to a force generated by rotation. When the rotation axis stops rotating, the reciprocating spring returns to an initial position to push the driver link to separate from the gear structure.

In some embodiments, the active ring, the driver link, and the reciprocating spring are located in the hub portion.

In some embodiments, the driver link, and the reciprocating spring are surrounded by the gear structure.

In some embodiments, the driver link is hook shape, L shape, V shape, or U shape.

In some embodiments, the driver link includes a first extending portion and a second extending portion adjoining the first extending portion, and an extending direction of the first extending portion is different from an extending direction of the second extending portion.

In some embodiments, the first extending portion is located between the active ring and the second extending portion, and the second extending portion is located between first extending portion and the gear structure of the hub portion.

In some embodiments, a length of the second extending portion is greater than a length of the first extending portion.

In some embodiments, the number of the driver links and the number of the reciprocating springs are both two, the two driver links are symmetrically disposed on the active ring, and the two reciprocating springs are symmetrically disposed on the active ring.

According to some embodiments of the present disclosure, a fluid transmission device includes a housing, a motor, and a rotor assembly. The housing has an accommodating space, wherein one end of the housing has an opening communicated with the accommodating space. The motor is located in the accommodating space of the housing. The rotor assembly is located in the accommodating space of the housing, and includes a rotation axis, a propeller, an active ring, at least one driver link, and at least one reciprocating spring. The rotation axis is connected to the motor. The propeller is located in the opening of the housing, and includes a hub portion and a plurality of fan blades extending outward from the hub portion. The hub portion is located on one end of the rotation axis, and an inner sidewall of the hub portion has a gear structure surrounding the rotation axis. The active ring sleeves on the rotation axis. The driver link is pivotally connected to the active ring. The reciprocating spring is telescopically disposed on the active ring and abutting against the driver link. When the rotation axis drives the active ring to rotate, the driver link abuts against the gear structure of the hub portion and compresses the reciprocating spring due to a force generated by rotation. When the rotation axis stops rotating, the reciprocating spring returns to an initial position to push the driver link to separate from the gear structure.

In some embodiments, the active ring, the driver link, and the reciprocating spring are located in the hub portion.

In some embodiments, the active ring, the driver link, and the reciprocating spring are surrounded by the gear structure.

In some embodiments, the driver link is L shape, V shape, U shape, or hook shape.

In some embodiments, the driver link includes a first extending portion and a second extending portion adjoining the first extending portion, and an extending direction of the first extending portion is different from an extending direction of the second extending portion.

In some embodiments, the first extending portion is located between the active ring and the second extending portion, and the second extending portion is located between first extending portion and the gear structure of the hub portion.

In some embodiments, a length of the second extending portion is greater than a length of the first extending portion.

In some embodiments, the number of the driver links and the number of the reciprocating springs are both two, the two driver links are symmetrically disposed on the active ring, and the two reciprocating springs are symmetrically disposed on the active ring.

In the aforementioned embodiments of the present disclosure, since the inner sidewall of the hub portion of the propeller has the gear structure and the rotor assembly has the driver link pivotally connected to the active ring and the retractable reciprocating spring, the position of one end of the driver link facing away from the active ring when the motor is in operation can be different from that of the driver link when the motor is stopped. As a result of such a design, when the motor rotates, the driver link can abut against the gear structure of the hub portion and compresses the reciprocating spring due to a force generated by rotation, thereby driving the propeller to rotate. In addition, when the motor stops rotating, due to no influence of a force generated by rotation, the reciprocating spring returns to an initial position by its elastic force to push the driver link to separate from the gear structure, such that the propeller rotates freely when a fluid passes through it, and the resistance when the fluid passes through can be effectively reduced to avoid obstruction to the flow of the fluid. The aforementioned gear structure, active ring, driver link, and reciprocating spring are located in the hub portion of the propeller, which can save space and is beneficial to miniaturization design and product competitiveness.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
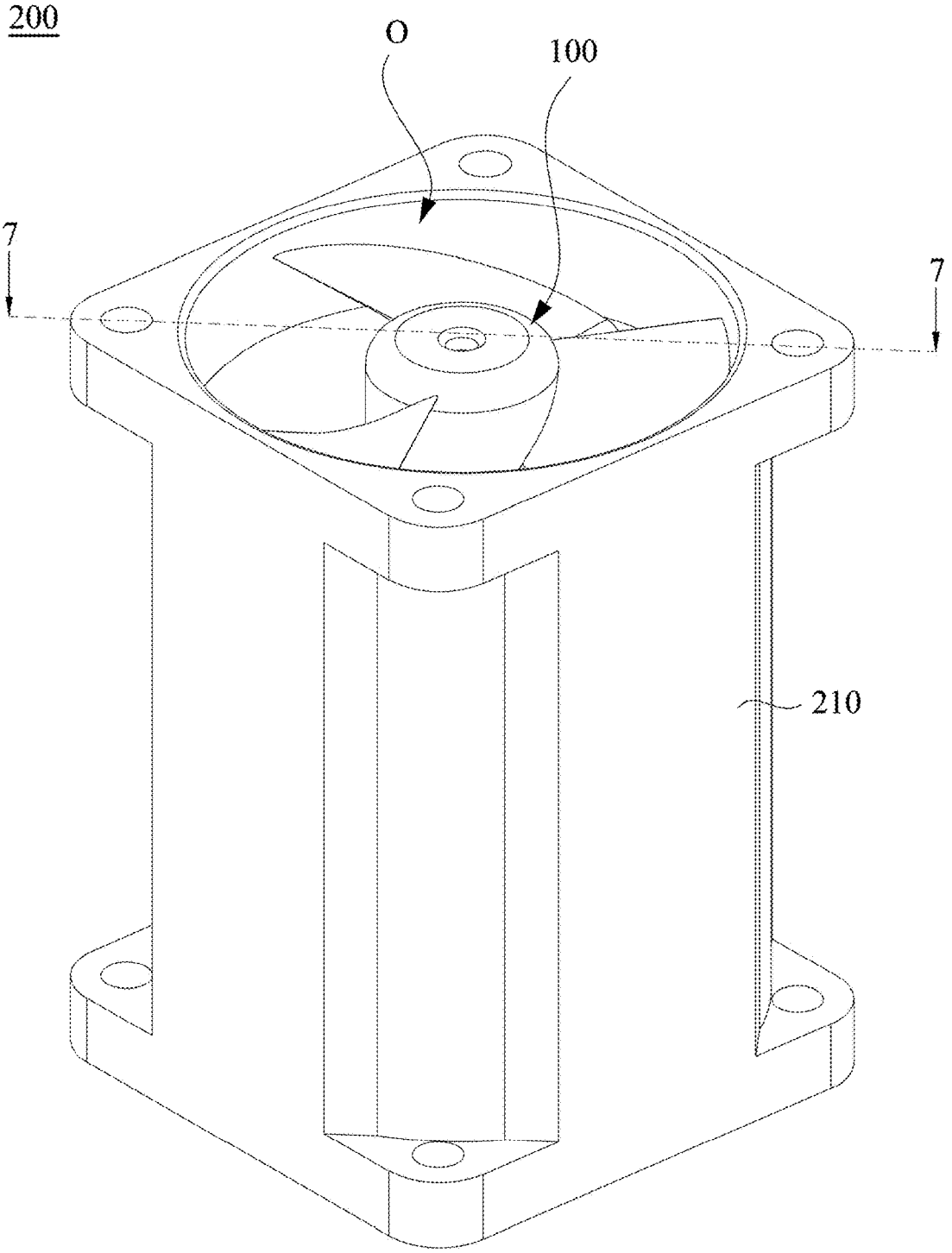
FIG. 1 is a perspective view of a fluid transmission device according to one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

Figure 2:
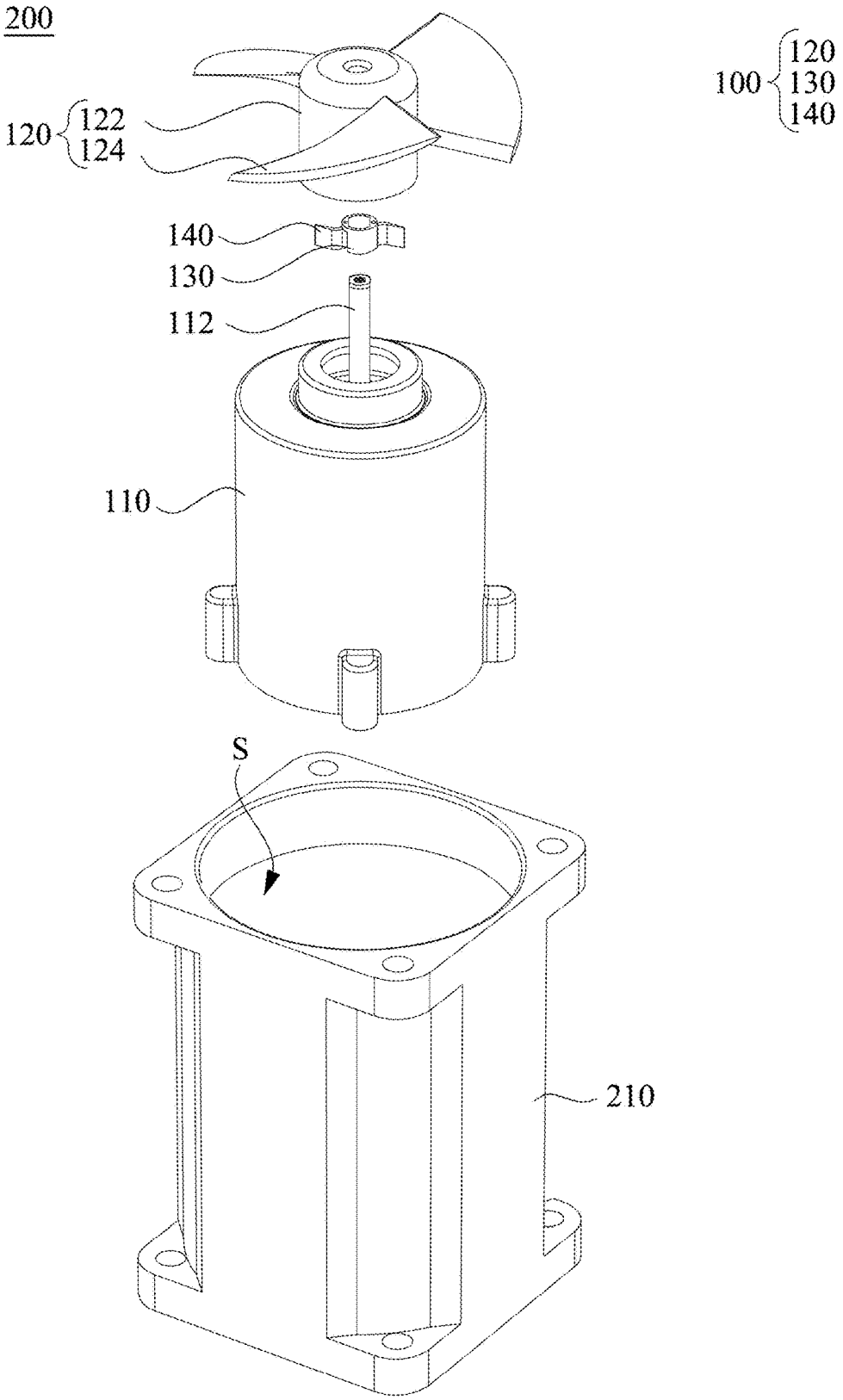
FIG. 2 is an exploded view of the fluid transmission device of FIG. 1.

FIG. 1 is a perspective view of a fluid transmission device 200 according to one embodiment of the present disclosure. FIG. 2 is an exploded view of the fluid transmission device 200 of FIG. 1. As shown in FIG. 1 and FIG. 2, the fluid transmission device 200 includes a housing 210, a motor 110, and a rotor assembly 100. In other embodiments, the motor 110 may be replaced with another driving component, and the present disclosure is not limited by the motor 110. The housing 210 has an accommodating space S, and one end of the housing 210 has an opening O communicated with the accommodating space S. The motor 110 is located in the accommodating space S of the housing 210. The rotor assembly 100 is located in the accommodating space S of the housing 210. The rotor assembly 100 includes a rotation axis 112, a propeller 120, an active ring 130, at least one driver link 140. The rotation axis 112 is connected to the motor 110 so as to be driven by the motor 110. The propeller 120 is located in the opening O of the housing 210, and includes a hub portion 122 and plural fan blades 124 extending outward from the hub portion 122. The hub portion 122 of the propeller 120 is located on one end of the rotation axis 112. The active ring 130 sleeves on the rotation axis 112, and the active ring 130 synchronously rotates with the rotation axis 112. Moreover, the driver link 140 is pivotally connected to the active ring 130.

In some embodiments, the fluid transmission device 200 may be used in a fluid heat dissipation system, such as a water cooling system or an air cooling system, as deemed necessary by users. The accommodating space S of the housing 210 can allow fluid to pass through. For example, the fluid enters the housing 210 of FIG. 1 from the bottom of the housing 210, passes through the outside of the motor 110, and flows out of the opening O of the top of the housing 210. In the following description, various components of the rotor assembly 100 when the motor 110 is in operation will be explained.

Figure 3:
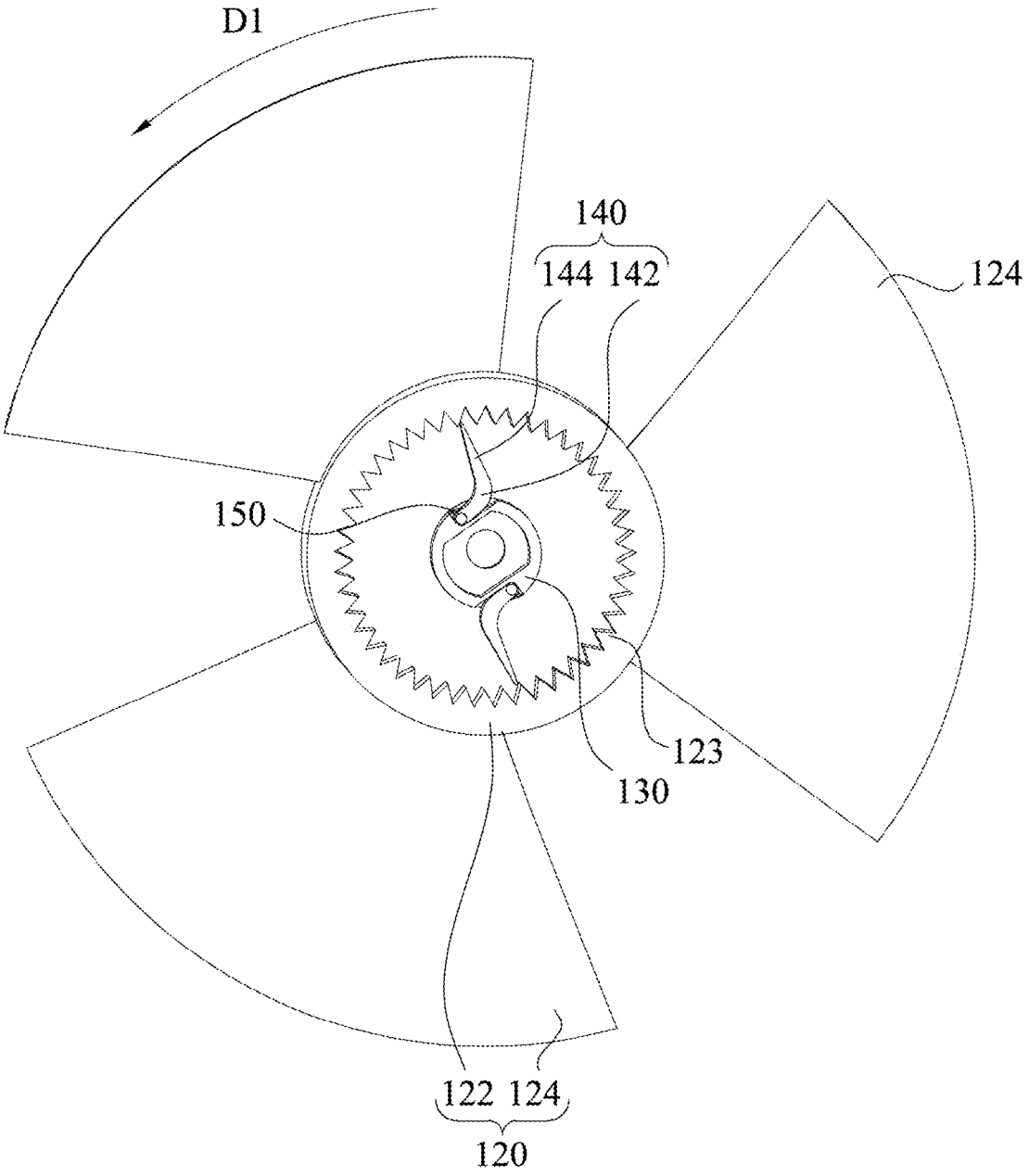
FIG. 3 is a bottom view of a propeller, an active ring, and a rotation axis of FIG. 2 that are assembled when a motor is in operation.

FIG. 3 is a bottom view of the propeller 120, the active ring 130, and the rotation axis 112 of FIG. 2 that are assembled when the motor 110 is in operation. In order to clarify and simplify the drawings, the rotation axis 112 are omitted in FIG. 3 to FIG. 6. As shown in FIG. 2 and FIG. 3, the inner sidewall of the hub portion 122 has a gear structure 123. In this embodiment, the gear structure 123 can be directly formed on the inner sidewall of the hub portion 122, and thus the gear structure 123 and the inner sidewall are integrally formed, but the present disclosure is not limited in this regard. When the propeller 120 is assembled to one end of the rotation axis 112, the gear structure 123 of the hub portion 122 surrounds the rotation axis 112, and surrounds the active ring 130 fixed on the rotation axis 112. As a result, the active ring 130, the driver link 140, and a reciprocating spring 150 are located in the hub portion 122 of the propeller 120, and are surrounded by the gear structure 123.

In some embodiments, as shown in FIG. 3, the driver link 140 may be hook shape, L shape, V shape, or U shape. The driver link 140 includes a first extending portion 142 and a second extending portion 144 adjoining the first extending portion 142, and the extending direction of the first extending portion 142 is different from the extending direction of the second extending portion 144, such as an obtuse angle between the first extending portion 142 and the second extending portion 144. The first extending portion 142 is located between the active ring 130 and the second extending portion 144, and the second extending portion 144 is located between first extending portion 142 and the gear structure 123 of the hub portion 122. Furthermore, the length of the second extending portion 144 is greater than the length of the first extending portion 142, but the present disclosure is not limited in this regard.

Figure 4:
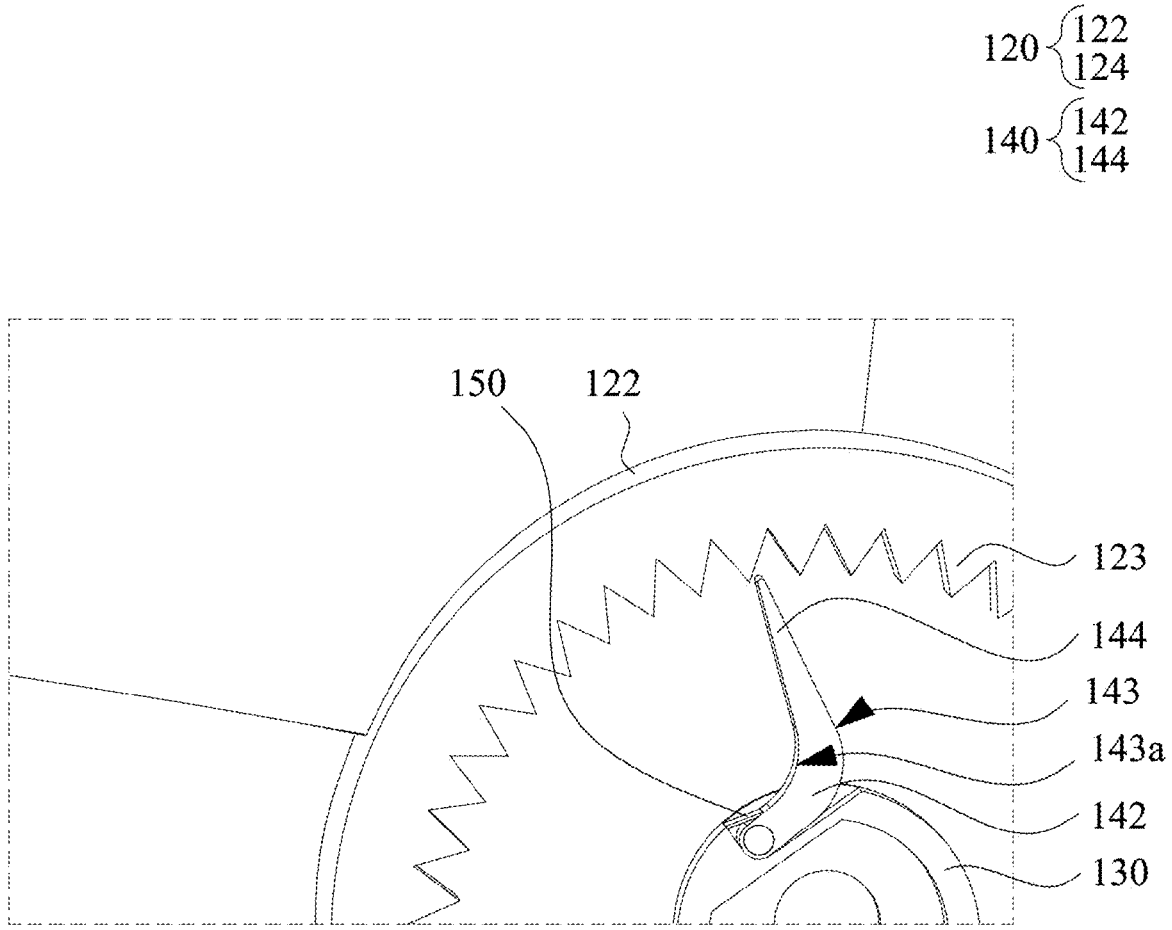
FIG. 4 is another view of FIG. 3 when viewed from upper left.

FIG. 4 is another view of FIG. 3 when viewed from upper left. As shown in FIG. 3 and FIG. 4, the driver link 140 can pivot on the active ring 130. The connection position of the first and second extending portions 142 and 144 has arc surfaces 143 and 143*a* respectively on two opposite sides of the driver link 140. In addition, the rotor assembly 100 includes at least one reciprocating spring 150. The reciprocating spring 150 is telescopically disposed on the active ring 130 and abuts against the driver link 140 to continuously provide an elastic force to the driver link 140 in a tilting direction (e.g., a force to the right in FIG. 4). However, when the motor 110 drives the active ring 130 to rotate in a direction D1 through the rotation axis 112 (see FIG. 2), the driver link 140 receives a force generated by the rotation of the active ring 130 is greater than the elastic force of the reciprocating spring 150, and thus the active ring 130 rotates to push the driver link 140. In this disclosure, the force generated by the rotation of the active ring 130 may include a centrifugal force and other forces due to rotation. As a result, the driver link 140 can abut against the gear structure 123 of the hub portion 122 and compresses the reciprocating spring 150, such that the driver link 140 drives the propeller 120 to rotate in the direction D1, as shown in FIG. 3.

In this embodiment, the number of the driver links 140 and the number of the reciprocating springs 150 are both two, the two driver links 140 are symmetrically disposed on the active ring 130, and the two reciprocating springs 150 are symmetrically disposed on the active ring 130. After assembling the propeller 120 to the rotation axis 112, the rotation axis 112 is located between the two driver links 140. Through the aforementioned symmetrical design, the stability associated with the rotation of the propeller 120 can be improved.

It is to be noted that the connection relationships, the materials, and the advantages of the elements described above will not be repeated in the following description. In the following description, various components when the motor 110 (see FIG. 2) is stopped will be explained.

Figure 5:
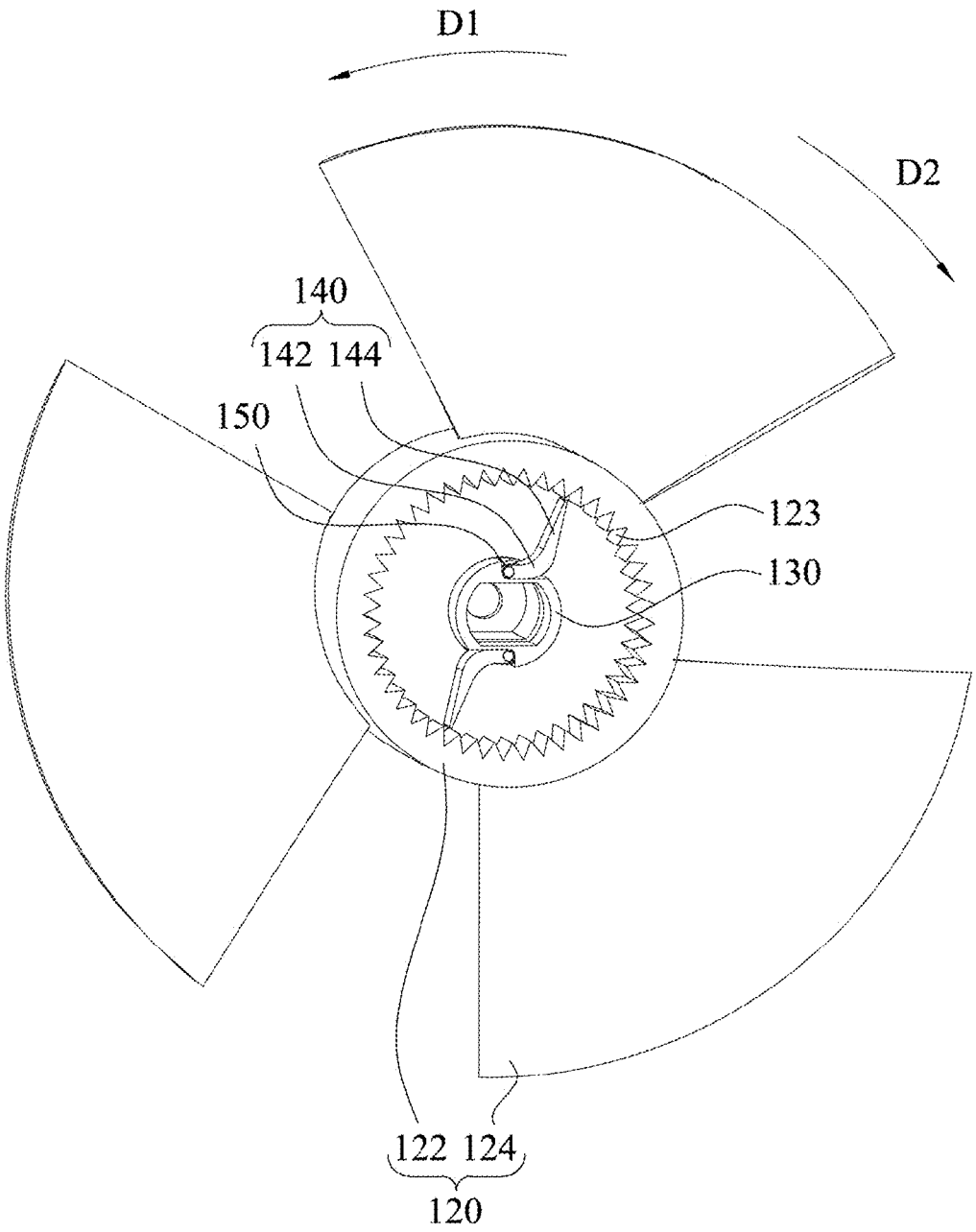
FIG. 5 is a bottom view of a driver link of FIG. 3 when the motor is stopped.
Figure 6:
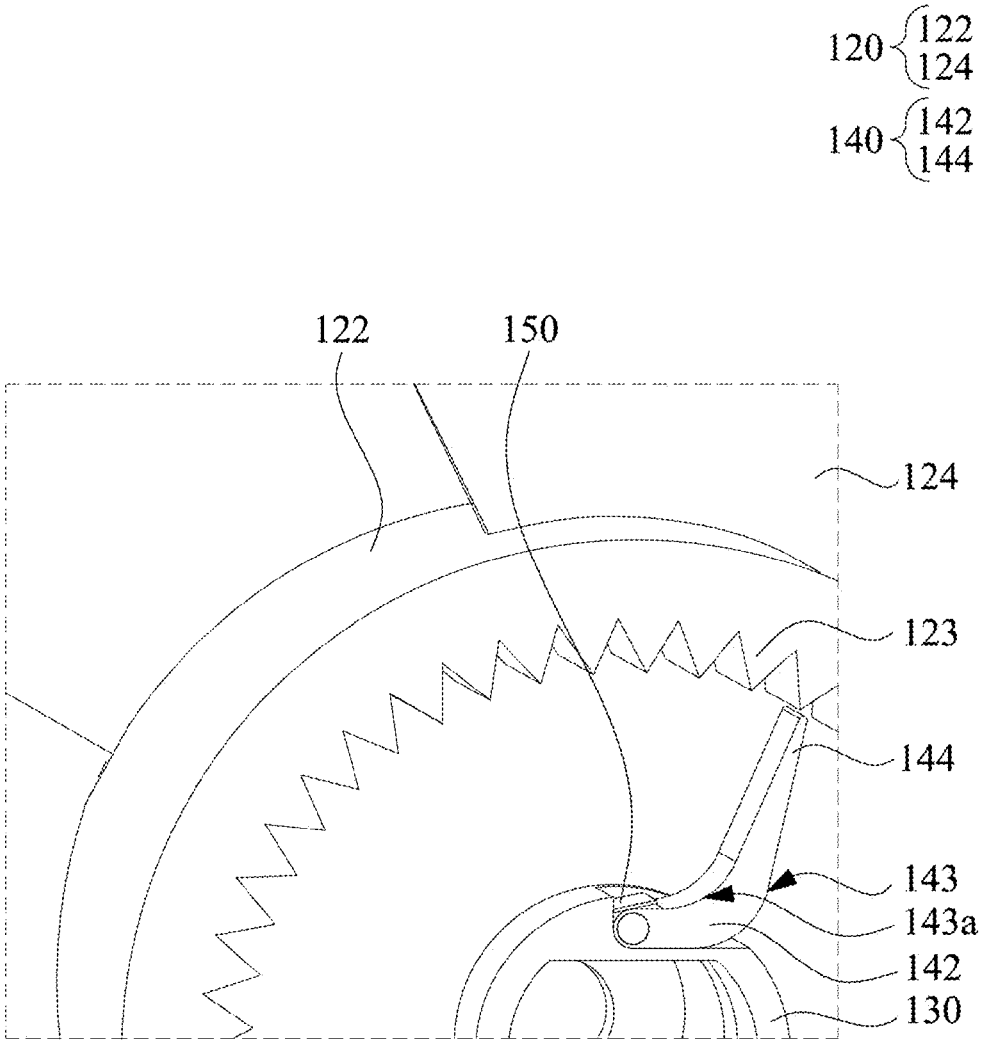
FIG. 6 is another view of FIG. 5 when viewed from upper left.

FIG. 5 is a bottom view of the driver link 140 of FIG. 3 when the motor 110 (see FIG. 2) is stopped. FIG. 6 is another view of FIG. 5 when viewed from upper left. As shown on FIG. 5 and FIG. 6, when the motor 110 stops running, the rotation axis 112 (see FIG. 2) does not drive the active ring 130 to rotate, and the driver link 140 does not receive a force (e.g., a centrifugal force) generated by the rotation of the active ring 130. Since the reciprocating spring 150 returns to an initial position due to its elastic force, the reciprocating spring 150 pushes the driver link 140 to the right in FIG. 6. Because the extending directions of the first and second extending portion 142 and 144 of the driver link 140 are different, the reciprocating spring 150 can push the driver link 140 to separate from the gear structure 123 of the hub portion 122, such that the driver link 140 is disengaged from the gear structure 123 and separated from each other. As a result, the propeller 120 is not driven by the motor 110, and can rotate freely on the rotation axis 112 (see FIG. 2). For example, the propeller 120 rotates freely in the direction D1 or a direction D2 based on conditions of fluid passing through the propeller 120, thereby realizing two-way transmission of fluid.

As can be seen from FIG. 3 and FIG. 5, since the inner sidewall of the hub portion 122 of the propeller 120 has the gear structure 123, and the rotor assembly 100 has the driver link 140 pivotally connected to the active ring 130 and the retractable reciprocating spring 150, the position of one end of the driver link 140 facing away from the active ring 130 when the motor 110 is in operation can be different from that of the driver link 140 when the motor 110 is stopped due to the different extending directions and lengths of the first and second extending portions 142 and 144.

Figure 7:
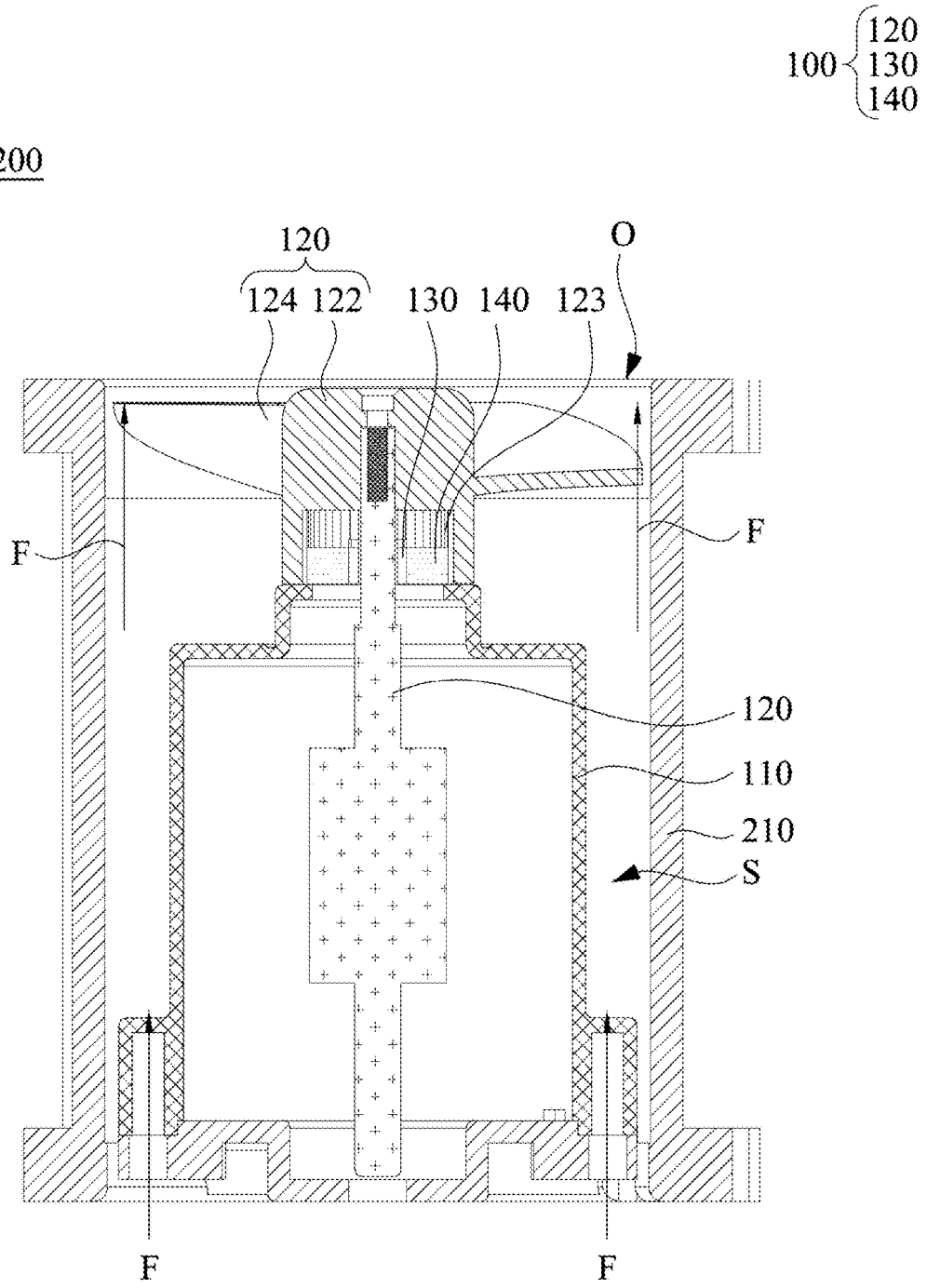
FIG. 7 is a cross-sectional view of the fluid transmission device of FIG. 1 taken along line 7-7.

FIG. 7 is a cross-sectional view of the fluid transmission device 200 of FIG. 1 taken along line 7-7. A fluid F passes through the fluid transmission device 200. In this embodiment, the fluid F may be water or other liquids. In other embodiments, the fluid F may be air or other gases. Through the design of the aforementioned rotor assembly 100, when the motor 110 rotates, the driver link 140 can abut against the gear structure 123 of the hub portion 122 and compresses the reciprocating spring 150 (see FIG. 3) due to a force (e.g., a centrifugal force) generated by the rotation of the active ring 130, thereby driving the propeller 120 to rotate and increasing the flow rate of the fluid F. In addition, when the motor 110 stops rotating, due to no influence of a force (e.g., a centrifugal force) generated by the rotation of the active ring 130, the reciprocating spring 150 can return to an initial position by its elastic force to push the driver link 140 to separate from the gear structure 123 (see FIG. 5), such that the propeller 120 rotates freely when the fluid F passes through it, and the resistance when the fluid F passes through can be effectively reduced to avoid obstruction to the flow of the fluid. Moreover, the freely rotating propeller 120 can allow the fluid F flowing in one direction or two directions, which is conducive to design flexibility.

In addition, the gear structure 123, the active ring 130, the driver link 140, and the reciprocating spring 150 (see FIG. 3) of the fluid transmission device 200 are all located in the hub portion 122 of the propeller 120, which can save space and is beneficial to miniaturization design and product competitiveness.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A rotor assembly, comprising:

a rotation axis;

a propeller comprising a hub portion and a plurality of fan blades extending outward from the hub portion, wherein the hub portion is located on one end of the rotation axis, and an inner sidewall of the hub portion has a gear structure surrounding the rotation axis;

an active ring sleeving on the rotation axis;

at least one driver link pivotally connected to the active ring; and at least one reciprocating spring telescopically disposed on the active ring and abutting against the driver link, wherein when the rotation axis drives the active ring to rotate, the driver link abuts against the gear structure of the hub portion and compresses the reciprocating spring due to a force generated by rotation, and when the rotation axis stops rotating, the reciprocating spring returns to an initial position to push the driver link to separate from the gear structure.

2. The rotor assembly of claim 1, wherein the active ring, the driver link, and the reciprocating spring are located in the hub portion.

3. The rotor assembly of claim 1, wherein the active ring, the driver link, and the reciprocating spring are surrounded by the gear structure.

4. The rotor assembly of claim 1, wherein the driver link is hook shape, L shape, V shape, or U shape.

5. The rotor assembly of claim 1, wherein the driver link comprises a first extending portion and a second extending portion adjoining the first extending portion, and an extending direction of the first extending portion is different from an extending direction of the second extending portion.

6. The rotor assembly of claim 5, wherein the first extending portion is located between the active ring and the second extending portion, and the second extending portion is located between first extending portion and the gear structure of the hub portion.

7. The rotor assembly of claim 5, wherein a length of the second extending portion is greater than a length of the first extending portion.

8. The rotor assembly of claim 1, wherein the number of the driver links and the number of the reciprocating springs are both two, the two driver links are symmetrically disposed on the active ring, and the two reciprocating springs are symmetrically disposed on the active ring.

9. A fluid transmission device, comprising:

a housing having an accommodating space, wherein one end of the housing has an opening communicated with the accommodating space;

a motor located in the accommodating space of the housing; and an rotor assembly located in the accommodating space of the housing, and comprising:

a rotation axis connected to the motor;

a propeller located in the opening of the housing and comprising a hub portion and a plurality of fan blades extending outward from the hub portion, wherein the hub portion is located on one end of the rotation axis, and an inner sidewall of the hub portion has a gear structure surrounding the rotation axis;

an active ring sleeving on the rotation axis;

at least one driver link pivotally connected to the active ring; and at least one reciprocating spring telescopically disposed on the active ring and abutting against the driver link, wherein when the rotation axis drives the active ring to rotate, the driver link abuts against the gear structure of the hub portion and compresses the reciprocating spring due to a force generated by rotation, and when the rotation axis stops rotating, the reciprocating spring returns to an initial position to push the driver link to separate from the gear structure.

10. The fluid transmission device of claim 9, wherein the active ring, the driver link, and the reciprocating spring are located in the hub portion.

11. The fluid transmission device of claim 9, wherein the active ring, the driver link, and the reciprocating spring are surrounded by the gear structure.

12. The fluid transmission device of claim 9, wherein the driver link is L shape, V shape, U shape, or hook shape.

13. The fluid transmission device of claim 9, wherein the driver link comprises a first extending portion and a second extending portion adjoining the first extending portion, and an extending direction of the first extending portion is different from an extending direction of the second extending portion.

14. The fluid transmission device of claim 13, wherein the first extending portion is located between the active ring and the second extending portion, and the second extending portion is located between first extending portion and the gear structure of the hub portion.

15. The fluid transmission device of claim 13, wherein a length of the second extending portion is greater than a length of the first extending portion.

16. The fluid transmission device of claim 9, wherein the number of the driver links and the number of the reciprocating springs are both two, the two driver links are symmetrically disposed on the active ring, and the two reciprocating springs are symmetrically disposed on the active ring.

* * * * *